US010926158B1

(12) United States Patent
Fox

(10) Patent No.: US 10,926,158 B1
(45) Date of Patent: Feb. 23, 2021

(54) SLIDE RAIL ATTACHMENT AND FASTENING SYSTEM FOR SKATEBOARDS

(71) Applicant: Jeremy Fox, Huntington Beach, CA (US)

(72) Inventor: Jeremy Fox, Huntington Beach, CA (US)

( * ) Notice: Subject to any disclaimer, the term of this patent is extended or adjusted under 35 U.S.C. 154(b) by 0 days.

(21) Appl. No.: 16/554,324

(22) Filed: Aug. 28, 2019

(51) Int. Cl.
*A63C 17/01* (2006.01)
*A63C 17/00* (2006.01)

(52) U.S. Cl.
CPC ..... *A63C 17/002* (2013.01); *A63C 17/01* (2013.01); *A63C 17/012* (2013.01)

(58) Field of Classification Search
CPC ..... A63C 17/01; A63C 17/017; A63C 17/002
USPC ..... 280/87.042
See application file for complete search history.

(56) References Cited

U.S. PATENT DOCUMENTS 4,031,988 A * 6/1977 Hill ..... A63C 17/01 188/250 B
4,040,639 A * 8/1977 Scardenzan ..... A63C 17/01 280/87.042
4,152,001 A * 5/1979 Christianson ..... A63C 17/01 280/11.28
4,199,165 A * 4/1980 Spitzke ..... A63C 17/01 280/11.209
4,824,139 A * 4/1989 Robbins ..... A63C 17/26 280/816
5,002,294 A * 3/1991 Franz ..... A63B 25/10 280/1.182
5,132,883 A * 7/1992 La Lumandier ..... A63C 17/26 280/87.042
5,211,419 A * 5/1993 Gorliez ..... A63C 9/00 280/611
5,716,562 A * 2/1998 Peart ..... A63C 5/12 264/45.3
6,214,142 B1 * 4/2001 Saputo ..... A63C 17/01 156/92
6,386,561 B1 * 5/2002 Hanson ..... A63C 17/01 280/11.27
6,454,361 B1 * 9/2002 Martin ..... A63C 17/22 301/37.22
6,854,748 B2 * 2/2005 Wimbish ..... A63C 17/017 280/14.21
7,192,039 B1 * 3/2007 Snedaker ..... A63C 17/0093 280/87.021
7,198,280 B2 * 4/2007 Hara ..... B60L 50/52 280/87.042
7,722,060 B1 * 5/2010 Clark ..... A63C 17/012 280/87.042

(Continued)

*Primary Examiner* — Jeffrey J Restifo
(74) *Attorney, Agent, or Firm* — Advantage IP Law Firm

(57) ABSTRACT

A skateboard deck rail attachment having an elongated rail body with a throughbore having a sliding surface aperture, a mounting surface aperture, and an enlarged intermediate section with a diameter larger than the diameter of the sliding surface aperture with at least one fastener having an enlarged head portion with a drive cavity being at least partially encapsulated within the enlarged intermediate section of the throughbore with the drive cavity remaining accessible through the sliding surface aperture, the fastener further including a threaded section extending beyond the mounting surface aperture and constructed to engage and fasten the rail body to the undersurface of the deck.

20 Claims, 8 Drawing Sheets

(56) References Cited

U.S. PATENT DOCUMENTS

| | | | | |
|---|---|---|---|---|
| 8,500,145 | B2 * | 8/2013 | Chen | A63C 17/0086<br>280/87.042 |
| 8,870,199 | B2 * | 10/2014 | Fehn | A63C 17/0046<br>280/87.042 |
| 8,936,263 | B2 * | 1/2015 | Rawlins | A63C 17/0093<br>280/87.042 |

* cited by examiner

SLIDE RAIL ATTACHMENT AND FASTENING SYSTEM FOR SKATEBOARDS

BACKGROUND

1. Field

The disclosure relates generally to the field of skateboarding and, more particularly, to skateboard rail attachments for use when sliding over support surfaces using a skateboard.

2. Background

Skateboarding has become one of the more popular activities requiring a recreational device used by a rider to move across a solid support surface. A conventional skateboard typically includes a narrow, elongated platform or deck with an uppermost riding surface and a bottom surface to which a pair of wheel assemblies may be attached. The deck is sufficiently sized to allow the rider to be able to place at least a portion of both feet on the uppermost surface when riding the skateboard. While many activities, tricks, and stunts may be accomplished with a skateboard, a favorite is sliding the deck across a support surface such as a curb or rail.

A conventional skateboard deck surface may be used for such sliding activities. However, the wood surface of a skateboard deck does not slide well on all terrains and the graphics applied to the underside of the skateboard deck are quickly worn off when sliding. For these reasons, it is commonplace to attach one or more slide rails to the undersurface of the deck to provide an alternative lower friction sliding surface as well as to protect the deck and graphics. The conventional slide rail for use with a skateboard, such as that shown in FIGS. 1A-1C, typically is constructed of plastic and includes an elongated rail body 10 with an opening 12 for inserting a fastener 14 with an enlarged head 16 terminating in a tool receiving slot 18 and an opposing threaded section 20 for engaging the undersurface of the deck. A conventional screw is commonly used as the fastener to secure the rail to the undersurface of the deck.

The problem with such conventional construction is at least three-fold. First, to accommodate the enlarged head of the screw entering the rail, the opening 12 has a diameter at least slightly greater than the outside diameter of the enlarged retaining head of the screw. Moreover, the area surrounding the opening is often countersunk to allow the enlarged head of the screw to reside at or below the outermost surface of the rail. As there are typically a set of four to six fasteners per rail, the collective enlarged openings 12 then introduce a set of weak points into the rail and reduce the amount of sliding surface provided by the rail. Such weak points tend to draw localized wear as the rail is repeatably slid over a support surface such as a curb or rail, often resulting in the premature failure of the rail about the weak points posed by the fastener entry points. Related to this collective weak point issue, it is also desirable for the rails to maintain a smooth surface over the entire length by wearing evenly. However, the localized wear around each of the screw hole locations creates different wear patterns and uneven surfaces over the length of the rail. These uneven surfaces create difficulties in controlling sliding tricks and maneuvers.

Second, as often encountered when screwing a fastener into a wooden skateboard deck, a portion of the deck expands or erupts from the surrounding deck surface to accommodate the entry of the threaded portion of the screw.

This mushrooming effect results in an expanded portion that becomes raised above the surrounding deck surface and inhibits a flush engagement between the rail body and the undersurface of the deck. Without a flush engagement, the rail is prone to wobble, teeter totter, or vibrate relative to the deck during use, such traits being highly undesirable.

Third, aligning the rail and fasteners when securing the rail to the deck is a cumbersome process. As there is no resistance to the upward movement (movement away from the deck) of the screw within the opening as the rail is pressed against the deck, this makes the fastening process more unwieldly and less accurate. Typically, the rail is held in place with one hand while the user attempts to screw in the fasteners one at a time using a hand or power tool. It will be appreciated that such approach commonly results in the screw tip wandering somewhat on the deck surface resulting in an inaccurate placement. This alignment is exacerbated when using multiple fasteners. Precise placement is often critical to predictably perform many stunts.

While a potential approach to better align the fasteners is to drill pilot holes to prevent such wandering, the pilot holes are an unwelcome and inconvenient additional process, requiring the use of a powered drill mounted with a specific sized drill bit.

Another potential approach is to use a template to align the fasteners. However, this adds an extra cost, increases installation time, and adds another part to keep track of in order to fasten the rails.

While the foregoing generally describes the drawbacks of using a conventional slide rail for use with a conventional skateboard, there remains a need for an improved slide rail attachment and fastening system that reduces the localized failure zones of the rail, enables a flush mount that eliminates or significantly reduces rail wobble, and facilitates a faster, improved, and convenient method of mounting one or more rail bodies to the undersurface of the deck.

SUMMARY

In accordance with at least one embodiment disclosed herein, a rail attachment for use with a skateboard having a deck having a riding surface and an opposing undersurface with a set of spaced apart trucks with wheels mounted thereon is disclosed as elongated rail having a sliding surface and an opposing mounting surface for placement against the undersurface of the deck, the rail including a throughbore with a sliding surface aperture having a first diameter, a mounting surface aperture, and an enlarged intermediate section with a second diameter larger than the first diameter disposed between the apertures and at least one fastener having an enlarged head portion with a drive cavity, the enlarged head section being at least partially encapsulated within the enlarged intermediate section of the throughbore with the drive cavity being accessible through the sliding surface facing aperture, the fastener further including a threaded section extending beyond the mounting surface aperture and constructed to engage and fasten the rail attachment to the undersurface of the deck.

In at least one embodiment disclosed herein, there is an enlarged deck portion receiving cavity concentrically disposed about an outermost diameter of the mounting surface facing aperture, the deck portion receiving cavity constructed to at least partially receive an expanding portion of the deck as the fastener is threaded into the undersurface of the deck sufficient to enable the mounting surface of the rail attachment to lay flush against the undersurface of the deck.

In at least one exemplary embodiment described herein, the enlarged head of the fastener is restricted from moving relative to the longitudinal axis of the throughbore.

In another exemplary embodiment, the drive cavity of the enlarged head of the fastener is recessed from the sliding surface facing aperture.

Methods of fastening the slide rail to the skateboard deck are also disclosed herein.

Various objects, features, aspects and advantages of embodiments will become more apparent from the following detailed description of preferred embodiments of the invention, along with the accompanying drawings in which like numerals represent like components.

BRIEF DESCRIPTION OF THE DRAWINGS

The slide rail attachment and fastening system embodiments are described herein with reference to drawings of preferred embodiments, which are merely intended to illustrate the embodiments disclosed herein and not be limiting.

DETAILED DESCRIPTION

Figure 1A:
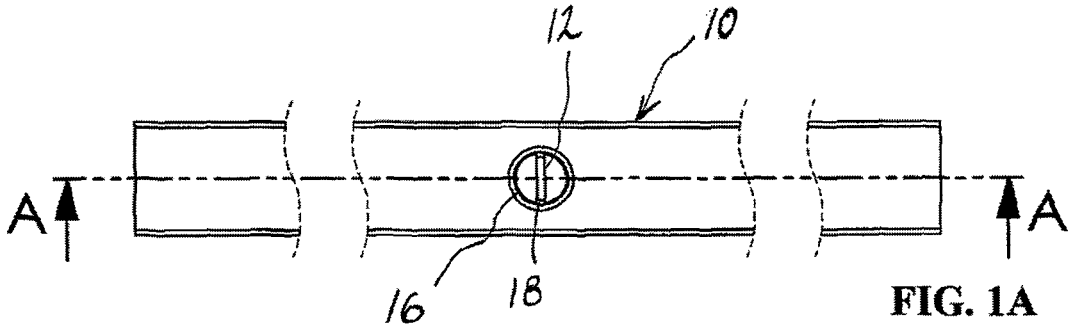
FIG. 1A (PRIOR ART)
FIG. 1A illustrates a broken top view of a conventional rail with conventional fastener inserted through a conventional countersink opening into the rail.
Figure 1B:
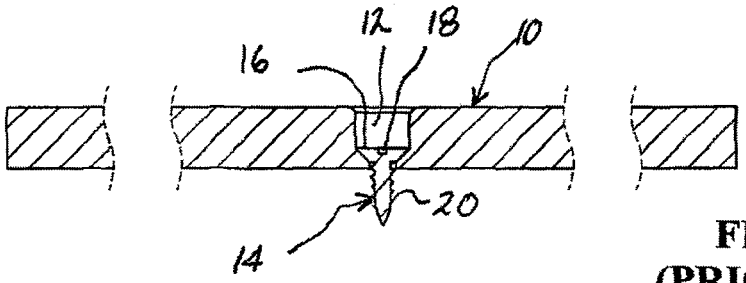
FIG. 1B (PRIOR ART)
FIG. 1B illustrates a cross-sectional view taken along lines A-A of FIG. 1A illustrating the conventional fastener within the countersink opening.
Figure 1C:
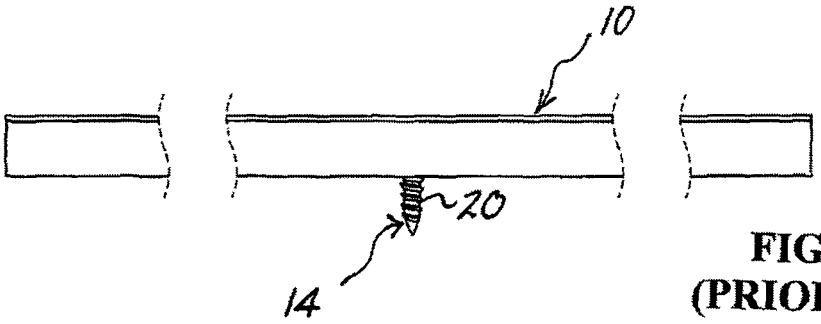
FIG. 1C (PRIOR ART)
FIG. 1C illustrates a broken side view of the conventional rail and threaded end of the conventional fastener extending outside the rail shown in FIG. 1A.

Referring initially to FIGS. 2A-2C and FIGS. 3-4, an exemplary slide rail attachment and fastening system embodiment, generally designated 30, is illustrated. Such embodiment 30 is constructed for use with a conventional skateboard, generally designated 32, having a deck 34 with a riding surface 35 and an opposing undersurface 37 from which a front truck 36 with a set of front wheels 38*a*, 38*b*, and a spaced apart rear truck 40 with a set of rear wheels 42*a*, 42*b* are mounted. The deck further includes two opposing elongated straight side edges 44, 46 and a front or nose end 47 and an opposing rear or tail end 48. It will be appreciated that a skateboard may be ridden in either direction and the terms front/nose and rear/tail are relative to the direction of travel as used herein.

Figure 2A:
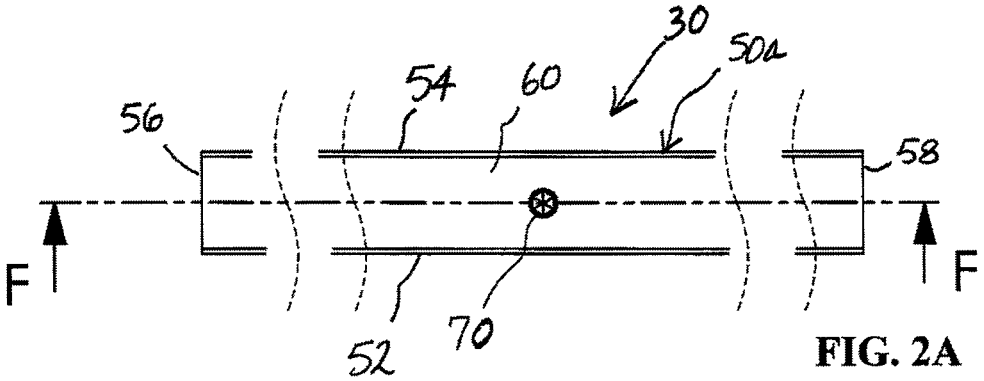
FIG. 2A illustrates a broken top view of an embodiment of a slide rail attachment and fastener for use with a skateboard.
Figure 2B:
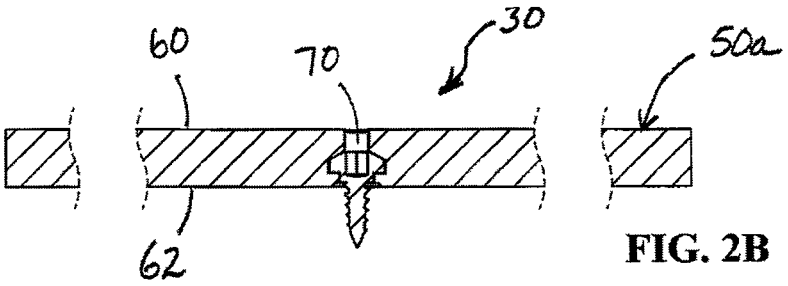
FIG. 2B illustrates a cross-sectional view taken along lines F-F of FIG. 2A illustrating the fastener at least partially captured in a rail body.
Figure 2C:
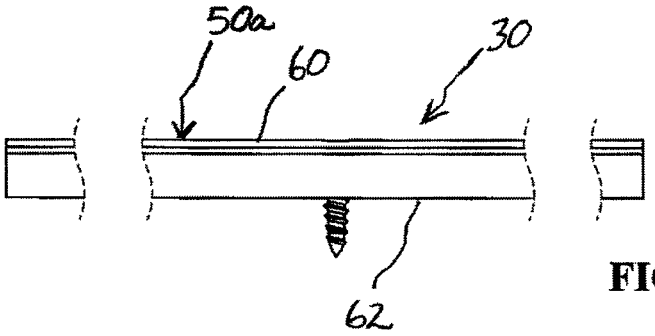
FIG. 2C illustrates a broken side view of the slide rail attachment and threaded end of the fastener extending outside the rail shown in FIG. 1A.
Figure 3:
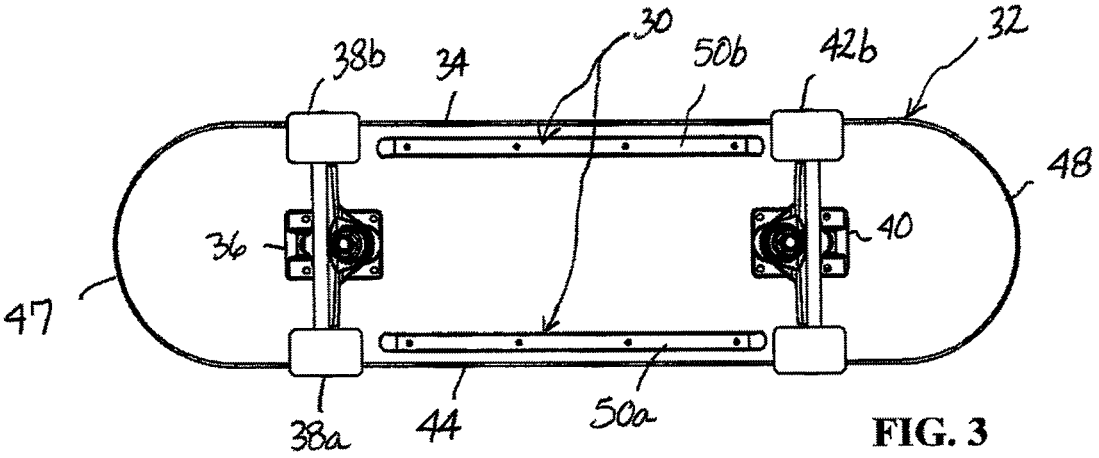
FIG. 3 illustrates a bottom view of a conventional skateboard deck with a set of trucks and wheels mounted thereon and a pair of slide rail attachment embodiments constructed in accordance with the principles of the present invention disclosed herein as attached to the undersurface of the conventional deck.
Figure 4:
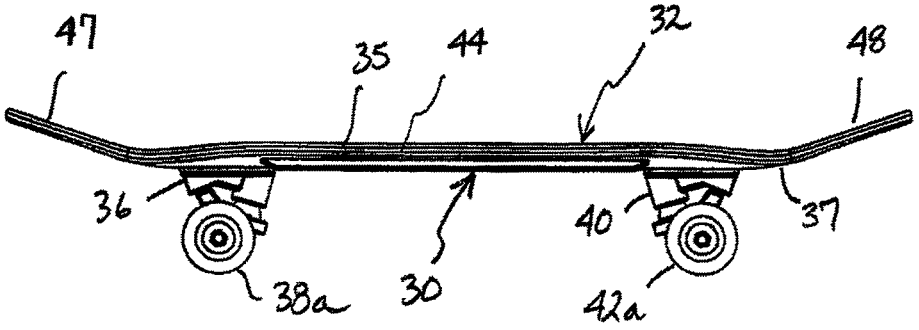
FIG. 4 illustrates a side view of the skateboard with rail attachments shown in FIG. 3.

With continued reference to FIGS. 2A-2C and FIG. 3, in this exemplary embodiment the slide rail attachment and fastening system 30 includes a pair of elongated, generally rectangular rail bodies 50*a*, 50*b*. In this exemplary embodiment, the rails 50*a*, 50*b* are identical. Rail 50*a* will be described for ease of explanation. As shown in FIGS. 2A-2C, rail 50*a* includes an outermost edge 52 (sidewall) recessed from but closer to the outermost edge 44 (FIG. 3) of the deck 34 than an opposing innermost edge 54 (sidewall) further recessed from the outermost edge of the deck as well as a front or leading edge 56 and an opposing rear or trailing edge 58, when viewed from above (FIG. 2A). The rail body 50*a* also includes a sliding surface 60 and an opposing mounting surface 62 as shown in FIGS. 2B-2C. The rail body 50*a* is preferably constructed of a hard, abrasion-resistant, plastic based material and is generally solid between the sliding surface and mounting surface but may be hollow or reinforced with ribs as well. It will be appreciated that the sliding surface 60, which is constructed to encounter an underlying support surface such as a curb or rail, may comprise the entire bottom surface of the rail body 50*a*, a portion thereof, or at least one of the edges 52, 54. Interior portions of the rail body 50*a* may also be recessed from the outermost edges 52, 54 forming a channel resulting in the outermost edges forming a pair of opposing rails to provide the sliding surface as well.

Figure 6A:
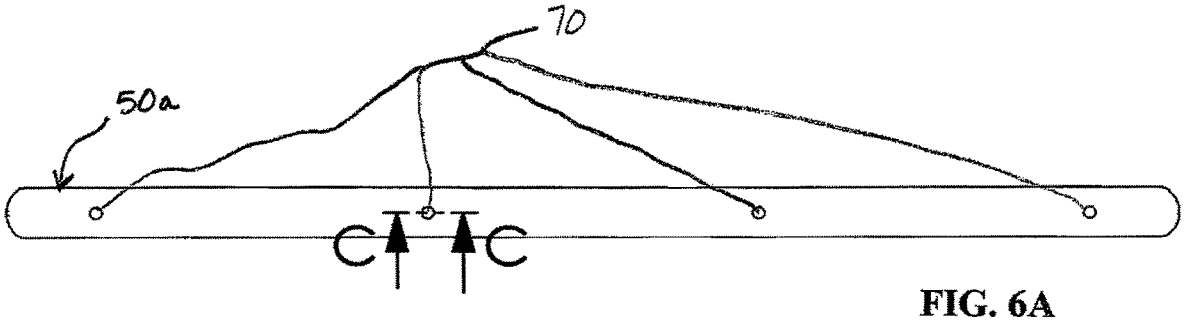
FIG. 6A illustrates a top view of an exemplary slide rail attachment embodiment illustrating a set of spaced apart tool receiving apertures.
Figure 6B:
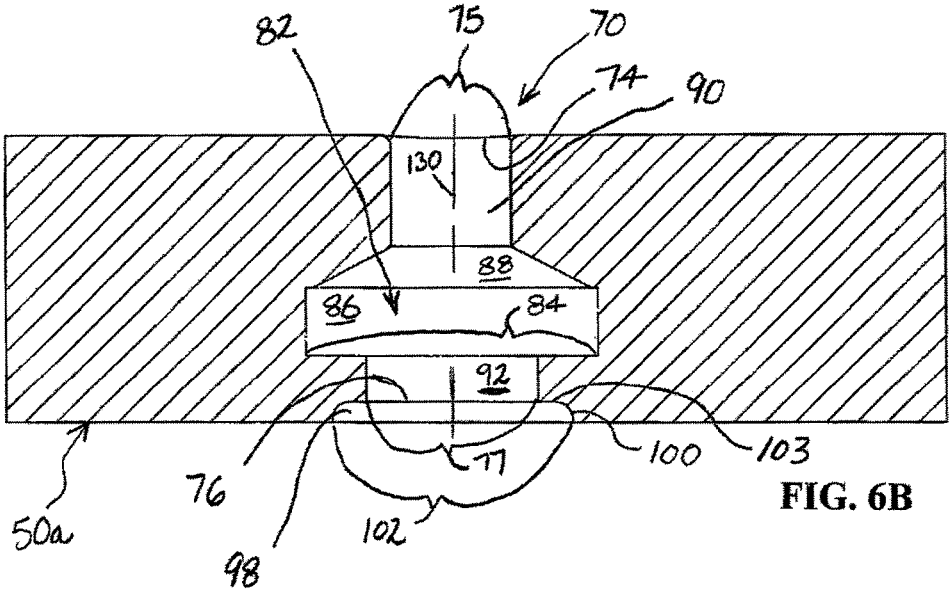
FIG. 6B illustrates a cross-sectional view taken along lines C-C of FIG. 6A, in enlarged scale, illustrating an exemplary throughbore in the slide rail attachment body.
Figure 7A:
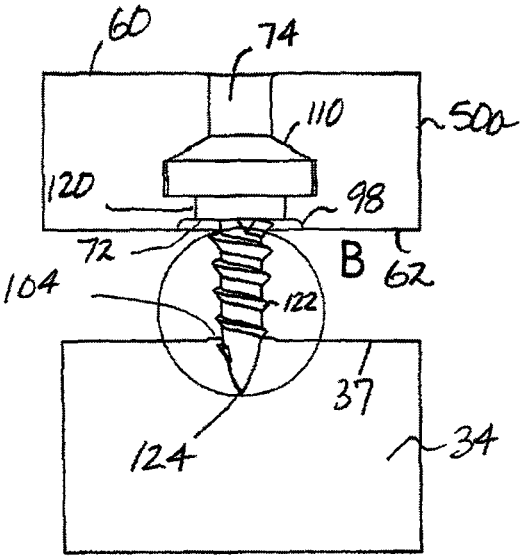
FIG. 7A illustrates a schematic view of an exemplary fastener embodiment initially penetrating the undersurface of the skateboard deck and illustrating the mushrooming effect.
Figure 7B:
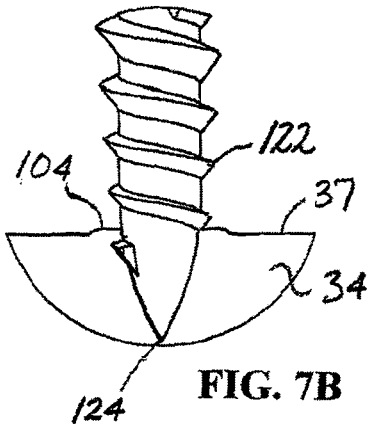
FIG. 7B illustrates a close-up view taken from circle B of FIG. 7A.

With reference to FIGS. 2A-2B and 6B, the rail body 50*a* incorporates at least one throughbore 70 extending from the sliding surface 60 to the mounting surface 62 and terminating at its respective outer ends in a sliding surface aperture 74 with a first diameter 75 (FIG. 6B) and a mounting surface aperture 76 having a second diameter 77. It will be appreciated that the sliding surface aperture 74 and mounting surface aperture 76 may face the respective sliding surface and mounting surfaces but be recessed therefrom as well as opposed to being disposed within the respective surfaces.

Figure 5:
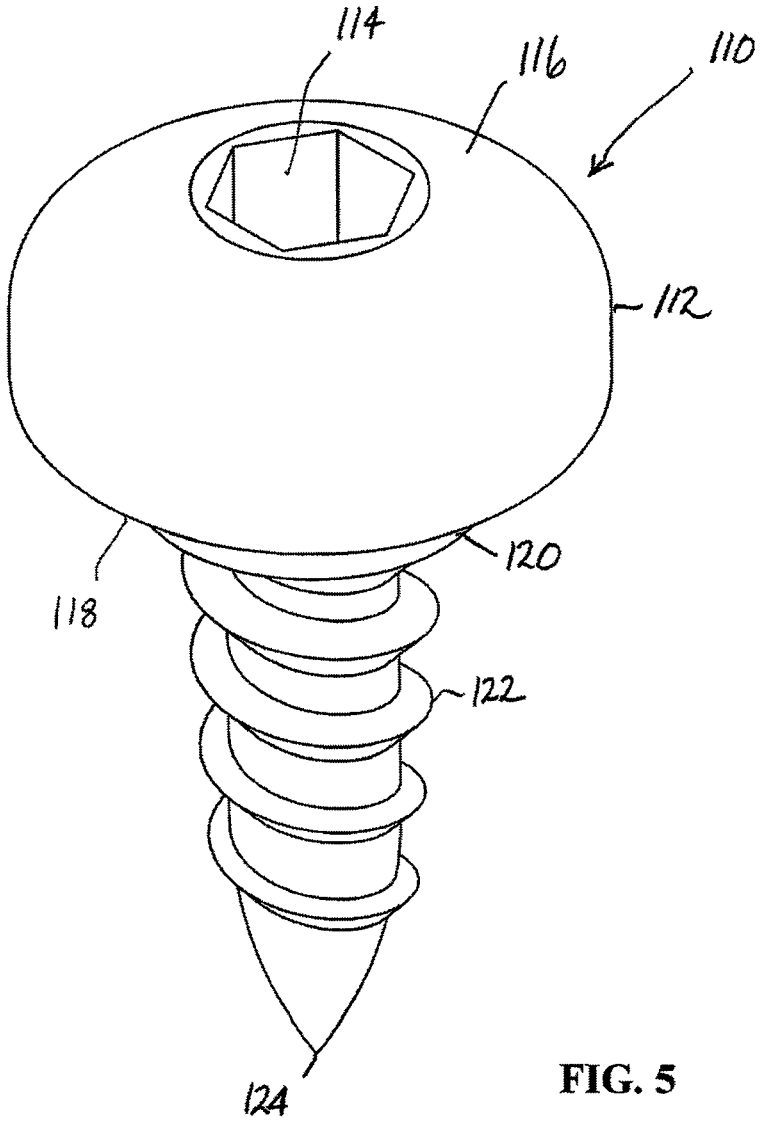
FIG. 5 illustrates a perspective view of an exemplary fastener embodiment for use with the rail attachment shown in FIGS. 2A-2C.
Figure 10:
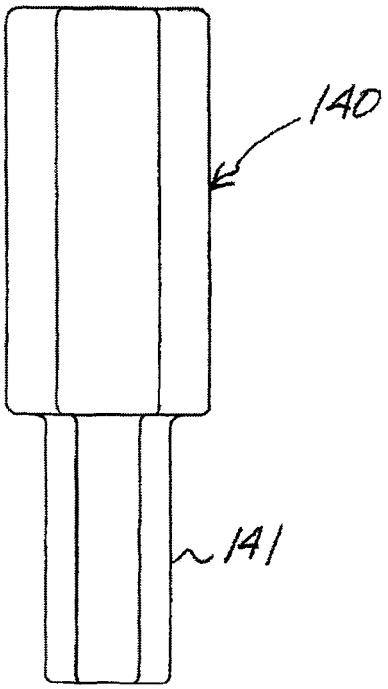
FIG. 10 illustrates a side view of an exemplary bit for use in engaging the drive cavity of the exemplary fastener shown in FIG. 5.
Figure 11A:
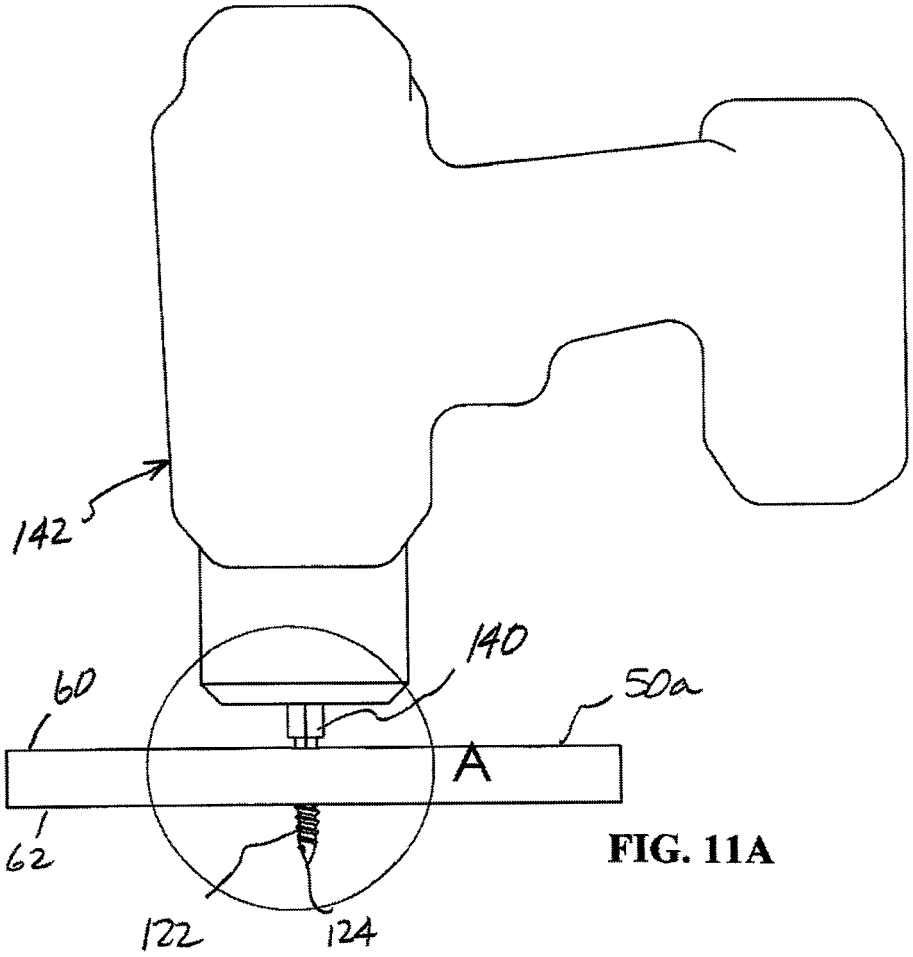
FIG. 11A illustrates a schematic side view of a power tool with the bit of FIG. 10 engaged with a fastener of the slide rail attachment illustrating a portion of the fastening process.
Figure 11B:
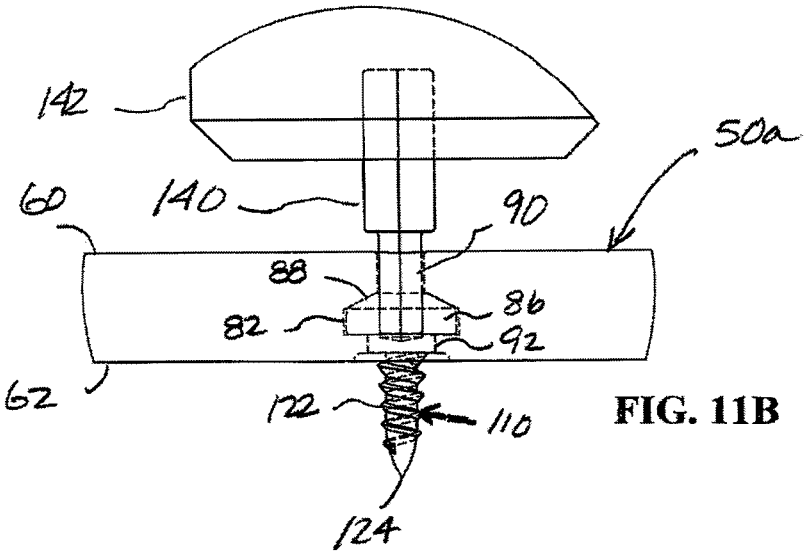
FIG. 11B illustrates a close-up view taken from circle A of FIG. 11A illustrating the hidden portions of the fastener and throughbore of the rail when viewed from the side.

Turning now to FIGS. 6A-6B and 11B, a cross-section of an exemplary throughbore 70 for use with the slide rail attachment and fastening system 30 is shown. In FIG. 6A, the rail body 50*a* is similar to that shown in FIG. 2A and is numbered the same. The only differences are that the rail body 50*a* in FIG. 6A is shown in its entirety and includes rounded ends and a set of four throughbores collectively numbered 70. An exemplary throughbore 70 will now be discussed. As discussed above, the throughbore includes sliding surface aperture 74 with a first diameter (D1) 75 and a mounting surface aperture 76 with a second diameter (D2) 77. Between these two opposing apertures, 74 and 76, the throughbore includes an enlarged chamber section 82 with a third diameter (D3) 84 that is greater than the sliding surface aperture diameter (D1) 75 and the mounting surface aperture diameter (D2) 77. The enlarged chamber section 82 includes a lower section 86 and an upper section 88 as viewed in FIGS. 6B and 11B. The lower section is cylindrical while the upper section is tapered inwardly from the outermost diameter 84 of the enlarged chamber section 84 toward a tool entry port 90 leading to the sliding surface aperture 74. The tool entry port 90 allows a drive tool such as a bit 140 (FIG. 10) entering through the sliding surface aperture 74 to access the drive cavity 114 (FIG. 5) and engage the enlarged head of the fastener 110 to turn the fastener within the throughbore 70.

With continued reference to FIGS. 6B and 11B, extending from the lower section 86 of the enlarged chamber section 82 is a shank section 92 leading to the mounting surface aperture 76. The shank section 92 has a diameter (D2) 77 less than the diameter 84 of the enlarged chamber section 82.

An alternative but preferred rail attachment feature, especially when fastening the rail 50*a* to a wooden or plastic skateboard deck, is a cavity 98 surrounding the mounting surface aperture 76 as shown in FIGS. 6B and 7A, 8A, and 9A-9B. As best shown in FIG. 6B, such cavity 98 includes a sidewall 100 with a fourth diameter (D4) 102 greater than the diameter 77 of the mounting surface aperture 76 and further includes a recessed upper surface 103 as viewed in FIGS. 6B and 9B. The cavity is constructed to receive an expanding portion 104 of the undersurface 37 of the deck 34 as the rail body 50*a* is coupled to the deck as described further below.

Referring to FIGS. 2B, 5, 7A-9B, and 11B, to secure the slide rail body 50*a* to the undersurface 37 of the deck 34, a fastener, generally designated 110, may be used. The fastener 110 includes an enlarged head section 112 with a screw drive cavity 114 recessed into the topmost surface 116 and extending part way into the fastener 110. In this exemplary embodiment, the screw drive cavity 114 is in the form of a hex head receiving cavity, although a phillips head, flathead slot, star-shaped cavity, triangular shaped cavity, square shaped cavity, or other suitable screw drive cavity may be used. The head section 112 may be flat, tapered, or slightly rounded in profile. In this exemplary embodiment, the head section is tapered inwardly toward the screw drive cavity 114. The lowermost surface 118 of the head section is preferably flat but may also be tapered or slightly rounded. A shank section 120 extends from the lowermost surface 118 of the head section 112 and has a smaller diameter than the head section 112. Extending from the shank section is a threaded section 122 which terminates in a pointed tip 124.

An exemplary, but non-limiting, fastener (rail screw) 110, may be constructed of high tensile steel grade, include a 1.5 pitch in the threaded section, have a tapered head of twenty-eight degrees from the uppermost horizontal, a screw drive cavity 114 constructed to receive a ⅛-inch allen key drive (hex head). The threaded portion 122 is preferably a self-tapping design.

The fastener 110 is at least partially encapsulated or captured by the throughbore 70. More specifically, during manufacture, the enlarged head section 112 of the fastener is disposed within the enlarged chamber section 82 of the throughbore and, due to the diameter differentials, the fastener is restricted from moving along a longitudinal axis 130 (FIG. 6B) passing through the throughbore while not being restricting from rotating relative to the sidewalls of the throughbore. This encapsulated arrangement facilitates lining up one or more fasteners along the undersurface 37 of the deck 34 when mounting the slide rail body 50 to the deck as the fasteners are not pushed back out through the throughbore as occurs in conventional rail attachments.

It is noteworthy that, in this exemplary embodiment 30, the diameter (D1) 75 of the sliding surface aperture 74 is less than the diameter (D3) 84 of the enlarged chamber section 82 of the throughbore. This significantly reduces the weakened regions of the rail body 50*a* overcoming at least one issue with the prior art.

The fastening process: Referring now to FIGS. 7A-11B, a tool bit 140 (FIG. 10) with a first end 141 complementary for insertion into the screw drive cavity 114 may be used to screw one or more slide rail bodies 50*a* to the undersurface 37 of the deck 34. A power tool 142 coupled to the bit may be used to speed up the process as well. It will be appreciated that the sharp tips 124 of each fastener 110 may initially be pressed into the undersurface 37 of the deck to impress a set of aligned pilot holes (not shown) into the mounting surface 37 of the deck 34 to guide the fasteners into the deck and inhibit the fastener tip 124 from wobbling about the undersurface during the fastening process.

The drive bit 140 may be inserted into the power tool 142 receptacle as would be understood by one of ordinary skill in the art (familiar with hand held power tools). With one hand, the slide rail body 50*a* may be held in place with the tips 124 disposed within the respective pilot holes. The outermost end 141 of the bit may be inserted into the drive socket (screw drive cavity) 114 of a selected fastener 110. Assuming, power has been provided to the drive tool 142, either by battery, pneumatic, hydraulic, or electrical, the drive tool is actuated to turn the drive bit and in turn twists the engaged fastener 110 within the throughbore 70. The screw end 122 of the fastener then burrows into the undersurface 37 of the deck 34. The process is repeated for each fastener to secure the rail body 50*a* to the undersurface 37 of the deck 34.

It will be appreciated that the slide rail body 50*a* is preferably constructed with some degree of flexibility to enable the fasteners 110 to maintain a perpendicular or relatively perpendicular disposition as the slide rail body is attached to the undersurface 37 of the deck 34. Such flexibility is sufficient to allow one or more fasteners to be secured to the deck while allowing other fasteners to remain in their respective pilot holes. The spacing of the throughbores allows facilitates screwing in one fastener at a time. In addition, instead of fastening one fastener at a time, the user may selectively fasten each fastener a portion of the way and switch between fasteners keeping all fasteners relatively at the same or similar level, and then complete the process by driving each fastener a portion of the way with several passes. Alternatively, an automated drive tool machine with a number of bits matching and aligned with the fasteners may be used to screw all fasteners simultaneously into the deck thus eliminating the need for a somewhat flexible rail body 50*a*.

Figure 8A:
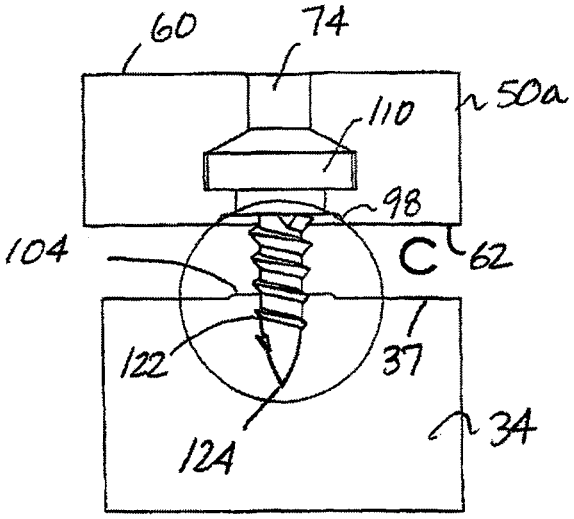
FIG. 8A illustrates a schematic view of the fastener from FIG. 7A further penetrating the skateboard deck.
Figure 8B:
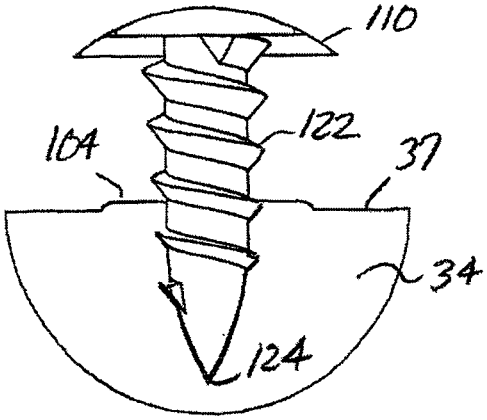
FIG. 8B illustrates a close-up view taken from circle C of FIG. 8A.
Figure 9A:
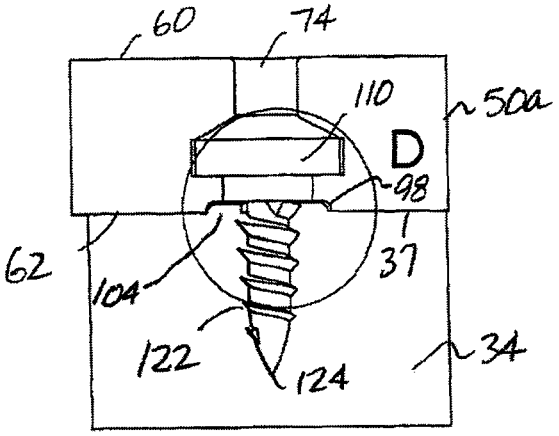
FIG. 9A illustrates a schematic view of the fastener from FIGS. 7A and 8A fully engaged with the undersurface of the skateboard resulting in a flush mounting arrangement between the slide rail body and the undersurface of the deck.
Figure 9B:
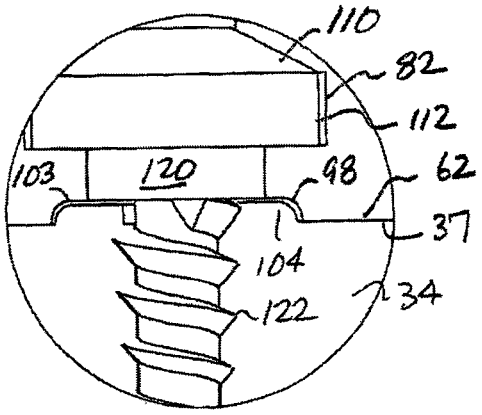
FIG. 9B illustrates a close-up view taken from circle D of FIG. 9A.

It will further be appreciated that the cavity 98 surrounding the mounting surface aperture 76 improves the connection between the rail body 50*a* and the undersurface 37 of the deck as well. As shown at an early stage of the fastening process in FIGS. 7A-7B, the tip 124 of the fastener 110 enters the undersurface 37 of the deck 34. As the tip penetrates the deck, a portion 104 of the deck mushrooms or expands outwardly to make room for the screw section 122 of the fastener. As the fastener further penetrates the deck as shown in FIGS. 8A-8B, the mushrooming (outward expansion of the deck) continues as the rail body 50*a* is drawn closer to the undersurface 37 of the deck 34. Then, when the fastening is complete, as shown in FIGS. 9A-9B, the mounting surface 62 of the rail body 50*a* is flush mounted with the undersurface 37 of the deck. Such flush mount is facilitated by the concentric cavity 98 surrounding each mounting surface aperture 78 which is constructed to receive all or a portion 104 of the mushrooming deck expansion. Such flush mount eliminates or at least significantly reduces the wobble between rail body and the deck, such wobble being an undesirable feature. The process may be repeated for the other rail body 50*b* on the other side of the undersurface of the deck resulting in a configuration shown in FIG. 3 for example. With the rail bodies 50*a*, 50*b* secured and flush mounted to the undersurface of the deck 34, the rider may perform sliding stunts, tricks, and maneuvers by engaging one or both of the slide rails 50*a*, 50*b* with an underlying support surface such as a curb or rail.

Specific embodiments and applications of a slide rail attachment and fastening system for skateboards have been described herein. However, it should be apparent, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Any objects cited herein may or may not be applicable to each embodiment and not all objects need be accomplished by any single embodiment.

What is claimed is:

1. A rail attachment for use with a skateboard having a deck with a riding surface and an opposing undersurface with a set of spaced apart trucks with wheels mounted thereon, the rail attachment comprising:

an elongated rail having a sliding surface and an opposing mounting surface for placement against the undersurface of the deck, the rail including a throughbore with a sliding surface aperture having a first diameter, a mounting surface aperture, and an enlarged intermediate section with a second diameter larger than the first diameter disposed between the apertures; and at least one fastener having an enlarged head portion with a drive cavity, the enlarged head section being at least partially encapsulated within the enlarged intermediate section of the throughbore with the drive cavity being accessible through the sliding surface aperture, the fastener further including a threaded section extending beyond the mounting surface aperture and constructed to engage and fasten the rail to the undersurface of the deck.

2. The rail attachment as set forth in claim 1 further comprising:

an enlarged deck portion receiving cavity concentrically disposed about an outermost diameter of the mounting surface aperture, the deck portion receiving cavity constructed to at least partially receive an expanding portion of the deck as the fastener is threaded into the undersurface of the deck resulting in a flush mount between the mounting surface of the rail and the undersurface of the deck.

3. The rail attachment of claim 1 wherein:

the drive cavity includes a hex head opening recessed into the head of the fastener, the hex head opening being smaller in diameter than the first diameter of the sliding surface aperture.

4. The rail attachment of claim 1 wherein:

the enlarged head of the fastener is restricted from moving relative to the longitudinal axis of the throughbore.

5. The rail attachment of claim 1 wherein:

the fastener is a screw and the rail extends between the trucks.

6. The rail attachment of claim 1 further comprising:

a plurality of fasteners with respective enlarged heads at least partially encapsulated in a set of throughbores.

7. The rail attachment of claim 6 wherein:

the plurality of fasteners are aligned in a same plane along a length of the rail.

8. The rail attachment of claim 1 wherein:

the fastener terminates in a pointed tip constructed to impart a pilot hole in the undersurface of the deck when depressed against.

9. The rail attachment of claim 1 wherein:

the enlarged head of the fastener is tapered inwardly toward the sliding surface aperture.

10. The rail attachment of claim 1 wherein:

the fastener includes a shank section between the enlarged head section and the threaded section.

11. The rail attachment of claim 1 wherein:

the rail is fastened to the deck in a position recessed from the deck edge.

12. The rail attachment of claim 1 wherein:

the rail is straight.

13. The rail attachment of claim 1 wherein:

the mounting surface is flush against the undersurface of the deck; and the drive cavity of the enlarged head of the fastener is recessed from the sliding surface aperture.

14. The rail attachment of claim 1 wherein:

the enlarged head of the fastener includes a flat surface facing toward the mounting surface aperture.

15. The rail attachment of claim 1 further comprising:

a plurality of spaced fasteners aligned in the same plane along the rail, the fasteners cooperating to align the rail along a section the undersurface of the deck prior to engaging the fasteners with a fastener driving tool.

16. The rail attachment of claim 1 wherein:

the drive cavity is constructed to receive a bit from a power tool to drive the fastener into the undersurface of the deck when mounting the rail thereto.

17. The rail attachment of claim 1 wherein:

the fasteners are built into the rail.

18. A rail attachment for use with a skateboard having a deck with a riding surface and an opposing undersurface with a set of spaced apart trucks with wheels mounted thereon, the rail attachment comprising:

an elongated rail having a sliding surface and an opposing mounting surface for placement against the undersurface of the deck, the rail including a throughbore with a sliding surface facing aperture having a first diameter, a mounting surface facing aperture, and an enlarged intermediate section with a second diameter larger than the first diameter disposed between the apertures;

at least one fastener having an enlarged head portion with a drive cavity, the enlarged head section being at least partially encapsulated within the enlarged intermediate section of the throughbore with the drive cavity being accessible through the sliding surface facing aperture, the fastener further including a threaded section extending beyond the mounting surface facing aperture and constructed to engage and fasten the rail to the undersurface of the deck; and an enlarged deck portion receiving cavity concentrically disposed about an outermost diameter of the mounting surface facing aperture, the deck portion receiving cavity constructed to at least partially receive an expanding portion of the deck as the fastener is threaded into the undersurface of the deck resulting in a flush mount between the mounting surface of the rail and the undersurface of the deck.

19. A method of assembling a skateboard rail to the undersurface of a skateboard deck, the method comprising:

providing an elongated rail having a sliding surface and an opposing mounting surface for placement against the undersurface of the deck, the rail including a throughbore with a sliding surface facing aperture having a first diameter, a mounting surface facing aperture, and an enlarged intermediate section with a second diameter larger than the first diameter disposed between the apertures;

providing at least one fastener having an enlarged head portion with a drive cavity, the enlarged head section being at least partially encapsulated within the enlarged intermediate section of the throughbore with the drive cavity being accessible through the sliding surface facing aperture, the fastener further including a threaded section extending beyond the mounting surface facing aperture and constructed to engage and fasten the rail to the undersurface of the deck;

aligning the pointed end of the fastener on the undersurface of the deck;

pressing the pointed end of the fastener into the undersurface of the deck to create a pilot hole;

providing a drive tool with a bit constructed to engage the drive cavity through the sliding surface facing aperture;

engaging the drive cavity with the bit with the pointed end of the fastener disposed within the pilot hole; and using the drive tool to threadably engage the fastener with the deck until the mounting surface is flush with the undersurface of the deck.

20. The method of claim 19 further comprising:

providing an enlarged concentric cavity around the mounting surface facing aperture, the concentric cavity constructed to receive at least a portion of the deck expansion as the fastener is threaded into the undersurface of the deck sufficiently to allow the mounting surface of the rail to rest flush against the undersurface of the deck when the fastener is fully engaged with the deck.

* * * * *